United States Patent [19]

Reimschissel

[11] Patent Number: 4,782,678

[45] Date of Patent: Nov. 8, 1988

[54] METHOD FOR MINIMIZING SCRAP LOSS IN MAKING A DRAWN CONTAINER

[75] Inventor: James F. Reimschissel, St. Louis, Mo.

[73] Assignee: Aluminum Company of America, Pittsburgh, Pa.

[21] Appl. No.: 73,267

[22] Filed: Jul. 14, 1987

[51] Int. Cl.[4] ..... B21C 51/00

[52] U.S. Cl. ..... 72/4; 83/72; 83/63; 83/371; 192/127

[58] Field of Search ..... 72/4, 3, 12, 31, 199, 72/240; 83/72, 63, 66, 67, 58, 209, 371; 192/126, 127, 125 A

[56] References Cited

U.S. PATENT DOCUMENTS

| | | | |
|---|---|---|---|
| 2,295,078 | 9/1942 | Green | 192/127 |
| 2,796,965 | 6/1957 | Lamoureux | 192/127 |
| 3,552,161 | 1/1971 | Garbe et al. | 72/4 |
| 4,669,344 | 6/1987 | Herrig | 83/72 |

FOREIGN PATENT DOCUMENTS

| | | | |
|---|---|---|---|
| 501725 | 4/1954 | Canada | 83/72 |

*Primary Examiner*—Daniel C. Crane

*Attorney, Agent, or Firm*—Elroy Strickland; Max L. Williamson; Thomas J. Connelly

[57] ABSTRACT

A method of minimizing scrap loss in making a drawn container in a multi-die set cupping or end shell press which includes monitoring the sheet for defects before entering the press. The monitor is adapted to detect a defect, send a signal to a control when such defect is detected, and the control thereafter interrupts the operation of the punch of at least the die set in line with the defect when the portion of the sheet having the defect therein enters the die set and suspends such operation until the defect passes through the die set.

5 Claims, 1 Drawing Sheet

METHOD FOR MINIMIZING SCRAP LOSS IN MAKING A DRAWN CONTAINER

BACKGROUND OF THE INVENTION

This invention relates to making a container. More particularly, it relates to monitoring sheet being fed to a multi-die cupper press or can end press for defects and interrupting the operation of a die set in the presses when a portion of the sheet having a defect is within the die set and thereby prevent a cup from being drawn or an end from being formed with the defective sheet.

A can body used in a two-piece can is either drawn or drawn and ironed. In either case, the first step in the manufacturing process is to feed sheet stock from a coil to a draw press where the sheet is blanked and drawn to finished size or drawn to form a cup for a later redraw and ironing. One very large market for drawn and ironed can bodies is for carbonated beverage containers. The market for such cans has steadily grown, and accompanying that growth has been an emphasis on reducing the thickness of metal in each container and increasing the production rate. In a modern can plant, the press to make the cup, called a cupping press or cupper, may typically have 12 identical die sets to make 12 cups with each stroke of the press and operate at speeds of 120–130 strokes/minute. It is of primary concern to the can manufacturer to make defect-free cups while running the cupper without interruption.

As a separate operation, sheet stock is fed from a coil to a stamping or drawing press where the stock is blanked, and the blank is then formed into a can end which is attached to the can end after it has been filled. As is the case with a cupper, the end shell press typically has multiple die sets, such as 22, for example, and may operate at speeds of 125–150 strokes/minute.

Heretofore, a press, whether a cupper or end shell press, has been shut down whenever more than anomalous or sporadic defective cups or ends are being produced in order to use the press efficiently and identify the reason for the defect. One source of defective cups or end shells is a defect in the sheet which manifests itself as an unacceptable flow or defect in the can body or end shell. The sheet may be out of tolerance in thickness or off-temper, for example. The defect may be only cosmetic in nature, such as streaks, for example. Other defects, however, such as slivers, rolled-over scratches, gouges, pinholes, rolled-in metals or inclusions, for example, may result in producing cups and end shells having flaws which affect their performance. A defect may extend across the entire width, but it is more likely that it appears in line with only one or two die sets. When a defect is encountered, it is often not possible to determine the extent of the defect through the coil, but rather than hazard the risk of producing a substantial number of defective cups, the usual practice is to shut the line down, remove the coil having the defect and replace it with a new coil. The removed coil would then be set aside and held for inspection by the coil manufacturer. Depending upon the nature of the defect and its location with respect to the beginning or end of the coil will determine whether additional material would be run off of the coil in the can plant in the hope that the defect extended only a short distance into the coil or whether it would be returned to the manufacturer. In any event, shutting down a can line because of defective sheet is disadvantageous and expensive for both the can maker and sheet manufacturer.

The impact of producing defective parts, however, may be substantially greater than shutting down a line and the unnecessary scrapping of good material. This is particularly true with respect to making ends. For example, the sheet defect may be undetected in a formed end which is subsequently used to seal a filled can. Such a defective end may result in an improper or inadequate seal of a can which does not manifest itself until pressure within the can from gas disassociated from the carbonated beverage has increased to the point to break the inferior seal and cause loss of carbonation or beverage. In some cases, such a leaker may not be discovered until the can has entered the distribution system. If the cause of the leak is then identified as resulting from a defect in the metal, any end made from the same coil or lot of metal may be suspect. The leaker may be only an anomaly, but even a small number traceable to a single coil or lot of material may result in the recall of all of the cans sealed with ends made from such coil or lot. It is apparent that the economic consequences of making defective ends can be out of all proportion to a small percentage of defective metal.

Many of the defects which arise during rolling of the sheet can be detected and corrections made to cure the defect. Because of the high rolling speeds, however, some defects may go undetected or it may be impractical to monitor the sheet as it is being produced to eliminate or minimize the defect. For example, methods are known to monitor the thickness of sheet as it is being rolled and, through a computer, change roll settings or other operating parameters to compensate for deviations from thickness. It is also known to monitor sheet as it is being rolled with television cameras to observe surface defects. Through a recorder or computer connection, the location and extent of the defect can be noted. Depending upon the nature and extent of the defect, the mill can be stopped and the defective material removed or the rolling can be continued and unwind the finished coil later to the extent necessary to remove the defective material. In any event, the control and/or removal of defects generated while rolling can be expensive and time-consuming to the sheet producer.

It is also known to monitor material being payed off of a coil to be processed in some fashion and stop the processing apparatus when a defect is noted. Abilock et al U.S. Pat. No. 3,786,265, for example, describes apparatus for detecting defects in a yarn sheet being fed to a warper. Two devices in tandem ahead of the warper monitor the yarn for defects. If both devices monitor the same defect, it is likely the defect is real and a signal may be sent for any desired purpose such as stopping the warper, for example. It is noted that the scope of the invention covers other coiled materials such as metal strips.

Heretofore, however, no process has been known for minimizing the amount of scrap in making a metal container by interrupting the operation of a cupper or end shell press to avoid making a defective cup or end shell while the passage of sheet continues through the press without interruption.

SUMMARY OF THE INVENTION

By a process of this invention coiled sheet stock being fed to a multi-die cupper or end shell press is monitored for the presence of defects by appropriate inspection devices before being blanked and drawn. When a defect is noted by the monitoring device, a signal is passed to a computer which is programmed to record the length of the defect and interrupt the operation of the press or a die set in line with the defect while any part of the defective portion is within the die set. When the monitoring device no longer picks up the defect, a second signal is sent to the press through the computer to begin operation again. By processing coiled stock in this manner, the processing apparatus can be operated continuously without processing portions of the stock having defects and thereby make the most efficient use of the material and the press.

It is an objective of this invention to provide a method of minimizing scrap generated in making containers by allowing material to pass uninterrupted through a cupper or end shell press without making defective cups or end shells.

This and other objectives and advantages of this invention will be more apparent with reference to the following description of a preferred embodiment and related drawings.

DESCRIPTION OF A PREFERRED EMBODIMENT

A preferred embodiment will be described with respect to making end shells on an end shell press. It is understood that the description applied to making a drawn cup as well. Referring to the figures, a coil of end stock 10 is mounted on a pay-off or unwind arbor 12 to feed material to an end shell press 14. Intermediate the arbor 12 and press 14, tensioning rolls, idler rolls, sheet accumulators, etc. (not shown) may be provided as needed to insure a uniform, uninterrupted feed of sheet material to the press. Also intermediate the arbor 12 and press 14 is a monitor 16 suspended above the sheet surface a distance appropriate for the particular monitor being used. The monitor may, of course, be positioned under the sheet if the bottom surface is to be monitored or a head may be both above and below the sheet if the monitor is a transducer type. The type of monitor used may be a matter of choice or may be dictated by the class of defect being monitored. Examples of what is meant by monitors or monitor types are television, lasers, X-rays or beta rays, but a method of this invention is not limited to a particular monitoring device. Thus, television and laser monitors may be used to detect surface class of defects while internal type defects are detected with X-rays. It is understood that more than one type of monitor to detect more than one class of defect can be used concurrently in a process of this invention.

Figure 1:
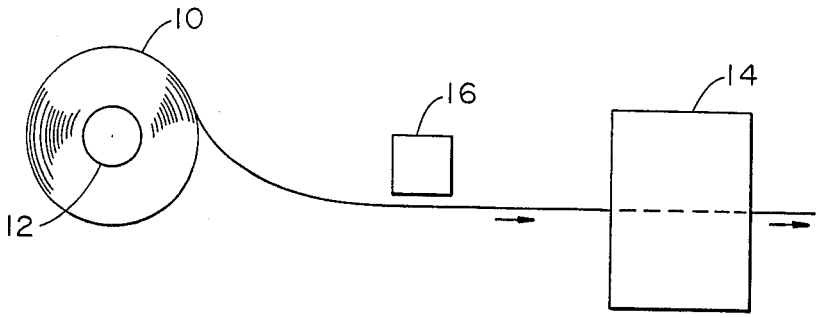
FIG. 1 is a schematic drawing of sheet being payed off an unwind mounted coil to a cupping or end shell press with a defect monitor means suspended over the sheet prior to its being received by the press.
Figure 2:
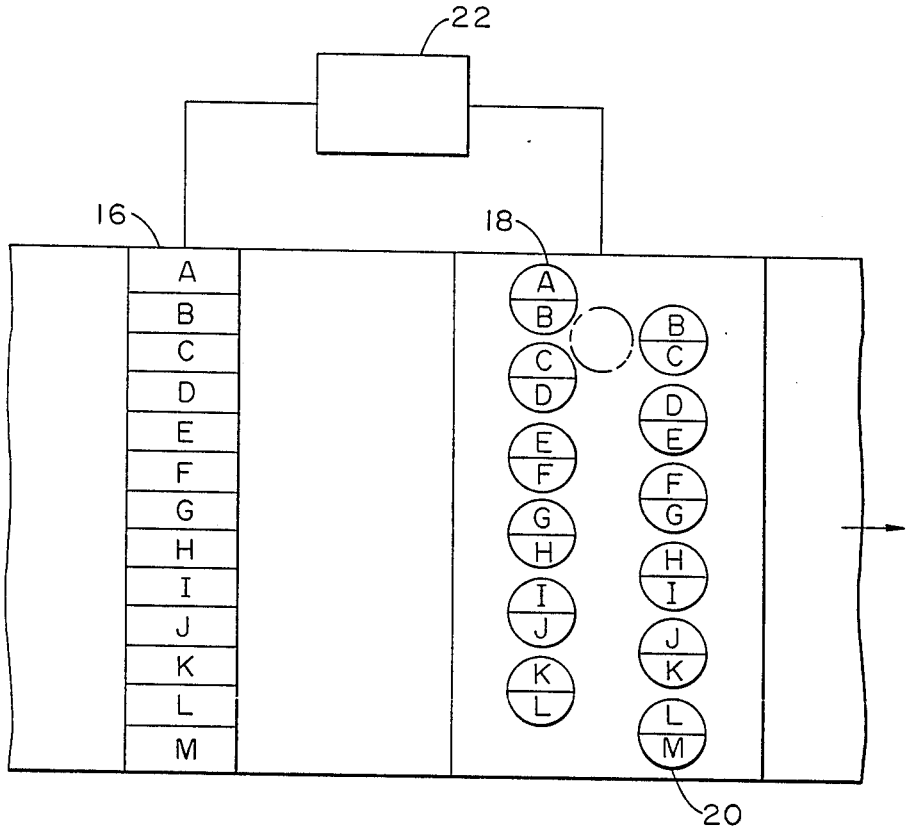
FIG. 2 shows a portion of sheet having monitor and die set locations superimposed thereon and also shows a computer connecting the two locations.

In the end shell press 14, a first row 18 of dies transverse to the length of the sheet has six blank and draw die sets. A second row 20 parallel to and spaced apart from the first row 18 also has six blank and draw die sets in a staggered arrangement with those in the first row. A multiple-die press for use in a method of this invention may be a conventional press wherein the punch portion of each die set operates from a common drive and the punches operate in unison. In an alternative, the press may be adapted so that the punches normally act in unison, but may be operated independently. Thus, the operation of one or more die sets can be interrupted while the remainder continue to operate. The sheet across its width is divided into 12 zones to be surveyed by the monitors 16. Referring to monitor 16 in FIG. 2, the first zone is designated by the letter A, the second by the letter B, and so on, and the monitor is adapted to view or scan each zone independent of other zones. Each of these zones is shown as superimposed on the die sets and it may be seen that each blank spans approximately two of the monitored zones.

A computer means 22 is interconnected with the monitor 16 and the cupper 14. As sheet stock 10 is payed off the arbor 12, it passes under the monitor 16 and into the press 14. As long as no defects are observed by the monitor 16, the press 14 will continuously operate to blank and draw 12 end shells at a time. After each stroke of the press, the formed shells are cleared from the press and the sheet is advanced for blanking and drawing of the next segment.

It may be noted that the rows 18, 20 of die sets are spaced apart a distance equal to approximately the diameter of the blank or a distance sufficient to fit in another row. The reason for spacing the rows in this manner is to make the most efficient use of the coil stock. The housings in the press for the die sets are of such a size that row 20 cannot be staggered closely with respect to row 18. In other words, more clearance between the die sets is required to fit the dies in the press than is needed for blanking purposes. If the spacing or pitch between rows 18, 20 is as shown, however, that is, with enough space to accommodate another row as shown by the phantom circle, efficient use can be made of the coil stock. After rows 18 and 20 are blanked and drawn, the sheet is advanced a distance equal to ½ the pitch which advances the material between rows 18, 20 to row 20 and new material would advance to row 18. Then on the next advance the sheet would move a distance equal to 1½ pitch. It may be seen that alternating movement of the sheet between ½ and 1½ times the pitch provides for optimum efficiency in using the available sheet.

Defects in the sheet may be isolated, repetitive or continuous in nature. An inclusion in an ingot may appear as an isolated spot or it may finally be rolled out and extended over a length of the sheet as the sheet is rolled to its final thickness, for example. If, on the other hand, an isolated defect on one of the rolls used to roll the sheet appears, it may in turn cause a defect in the sheet spaced apart a distance equal to the circumference of the roll. Regardless of the type of defect, apparatus of this invention can be used to prevent fabrication of flawed end shells from sheet having a defect capable of being detected by the particular monitor being employed.

If a defect is observed in zone A by the monitor 16, a signal is sent to the computer means 22. The length or extent of the defect can be determined by the computer from the elapsed time that the defect is observed and the speed of the feedstock, or the length of the defect may be measured with reference to strokes of the press. Since the distance of monitor 16 from the press 14 is also known, a signal can be sent to the press after a proper delay which will suspend operation of the punch in the first die set in row 16 when the defective material arrives at the die set if the press is adapted for independent punch action. In the alternative, if the press is conventional, operation of all of the punches will be stopped. Operation of one or more of the punches will then be suspended until the defective material has cleared the press.

By a method of this invention, the scrap exiting the press will include that having defects and the normal skeletal scrap which results from blanking and drawing the end shell. These two classes of scrap can then be segregated for appropriate accountability purposes.

Methods of ejecting defective articles of manufacture are known. Thus, a monitor through the computer control could be adapted to activate an eject mechanism to kick an end shell out of line after it is made rather than interrupt the production of the end shell. This method of operating a press would have the advantage of using all of the good material available while preventing defective end shells from being processed further. It is disadvantageous, however, in causing extra wear and increasing the risk of damage to tools, as well as creating the possibility of making additional defective end shells. If one of the die sets picks up an extraneous piece of metal which then adheres to the punch, permanent tool damage could occur or the extraneous metal could then cause a defective end shell to be produced from good metal with each stroke of the press. Such defective end shells could then remain undetected and result in producing sealed containers which later become leakers, as has been discussed heretofore.

While the invention has been described in terms of preferred embodiments, the claims appended hereto are intended to encompass all embodiments which fall within the spirit of the invention.

What is claimed is:

1. A method of minimizing the generation of scrap in cutting articles from a strip of sheet material in a press, said press having a plurality of cooperative reciprocating punch and die sets arranged in an adjacent relationship to cut out a plurality of articles across the width of said sheet material, said method comprising the steps of:

(a) unwinding said sheet material from a coil horizontally positioned on a coil mount;

(b) feeding sheet material from said coil into said press, said sheet material being advanced at a predetermined speed selected relative to the reciprocal speed of said punch and die sets;

(c) positioning a monitor apparatus in close proximity to said sheet material and at a preselected distance upstream of said press, said monitor apparatus being capable of detecting any defects present across the width of said sheet material and generating corresponding signals as to the size and location of the defects on said sheet material;

(d) relaying said size and location signals of said defects to a controller which is operatively connected to each of said punch and die sets; and (e) controlling the operation of each of said punch and die sets in correspondence to said size and location signals received from said monitor apparatus to cut articles out of said sheet material only in those areas where no defects are detected and suspending cutting where a defect is detected while intermittently advancing said sheet material through said press until said defect on said sheet material clears said punch and thereafter resume operation of said punch and die sets to continue cutting articles from said sheet material in only said areas.

2. The method of claim 1 wherein said monitor apparatus includes two or more monitors positioned adjacent each other to monitor the entire width of said sheet material.

3. The method of claim 1 wherein said monitors are arranged in a side-by-side relationship and each scans a portion of the width of said sheet material.

4. The method of claim 3 wherein there are six or more monitors arranged side-by-side across the entire width of said sheet material.

5. The method of claim 1 wherein said press contains at least two staggered rows of multiple punch and die sets each of which is controlled by an upstream monitor, said staggered rows assisting in minimizing the amount of scrap material remaining after said articles are cut out of said sheet material.

* * * * *